US010937370B2

(12) United States Patent
Son

(10) Patent No.: US 10,937,370 B2
(45) Date of Patent: Mar. 2, 2021

(54) DATA DRIVING CIRCUIT, DISPLAY PANEL AND DISPLAY

(71) Applicant: LG DISPLAY CO., LTD., Seoul (KR)

(72) Inventor: SungYoung Son, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/685,889

(22) Filed: Nov. 15, 2019

(65) Prior Publication Data

US 2020/0160788 A1 May 21, 2020

(30) Foreign Application Priority Data

Nov. 16, 2018 (KR) ..... 10-2018-0141262

(51) Int. Cl.
*G09G 3/3258* (2016.01)
*G09G 3/3275* (2016.01)
*G09G 3/20* (2006.01)

(52) U.S. Cl.
CPC ..... *G09G 3/3258* (2013.01); *G09G 3/2003* (2013.01); *G09G 3/3275* (2013.01); *G09G 2320/0247* (2013.01)

(58) Field of Classification Search
CPC .. G09G 3/3258; G09G 3/2003; G09G 3/3275; G09G 2320/0247
See application file for complete search history.

(56) References Cited

U.S. PATENT DOCUMENTS

| | | | | |
|---|---|---|---|---|
| 6,703,993 | B2 * | 3/2004 | Miura | G09G 3/3651 345/87 |
| 9,117,390 | B2 * | 8/2015 | Han | G09G 3/3233 |
| 10,373,575 | B2 * | 8/2019 | Park | G09G 3/3666 |
| 10,417,971 | B2 * | 9/2019 | Lin | G09G 3/3266 |
| 2006/0017394 | A1 * | 1/2006 | Tada | G09G 3/3233 315/169.3 |
| 2009/0109138 | A1 * | 4/2009 | Choi | G09G 3/2965 345/60 |
| 2018/0166015 | A1 * | 6/2018 | Beak | H01L 27/3262 |
| 2018/0166017 | A1 * | 6/2018 | Li | G09G 3/3233 |
| 2018/0174512 | A1 * | 6/2018 | Yuan | G09G 3/3233 |
| 2018/0175131 | A1 * | 6/2018 | Lee | H01L 27/3276 |
| 2018/0175320 | A1 * | 6/2018 | Lee | H01L 51/5221 |
| 2018/0176525 | A1 * | 6/2018 | Wu | H04N 9/646 |

* cited by examiner

*Primary Examiner* — Sejoon Ahn
(74) *Attorney, Agent, or Firm* — Birch, Stewart, Kolasch & Birch, LLP

(57) ABSTRACT

Data driving circuits, display panels and display devices are discussed. In accordance with embodiments of the present disclosure, when the display device is driven in a low-speed drive mode, by periodically resetting a voltage of an anode electrode of a light-emitting element EL in a holding interval, it is possible to enable a waveform of luminescence representing in the holding interval to be identical or similar to a waveform of luminescence representing in the refresh interval and it is therefore possible to prevent flickers from occurring. In addition, one or more reset voltages can be independently set according to driving conditions in the low-speed drive mode, and one or more changed reset voltages can be supplied according to the driving conditions. Therefore, it is possible to further overcome a flicker phenomenon by supplying an optimal reset voltage in various driving conditions in the low-speed drive mode.

18 Claims, 18 Drawing Sheets

Refresh

Holding

Vdata
VDD
DL
DVL
EM2
EML2
T5
SCAN1
SCL1
T3
N1
N2
T2
SCAN2
SCL2
Cst
N3
T1
Iel
EM1
EML1
T4
N4
T6
EL
Vini
IVL
VSS
SCAN1
SCAN2
EM1
EM2

Anode Reset

Vdata
VDD
DL
DVL
EM2
EML2
T5
SCAN1
SCL1
T3
N1
N2
T2
SCAN2
SCL2
Cst
T1
N3
EM1
EML1
T4
Vrst
N4
T6
EL
Vini
IVL
VSS
SCAN1
SCAN2
EM1
EM2

DATA DRIVING CIRCUIT, DISPLAY PANEL AND DISPLAY

CROSS-REFERENCE TO RELATED APPLICATION

This application claims the priority benefit of Korean Patent Application No. 10-2018-0141262, filed on Nov. 16, 2018 in the Korean Intellectual Property Office, the disclosure of which is incorporated herein by reference in its entirety.

BACKGROUND

Field of the Disclosure

The present disclosure relates to data driving circuits, display panels and display devices.

Description of the Background Art

As the information-oriented society has been developed, various needs for display devices for displaying an image have increased. Recently, various types of display devices, such as Liquid Crystal Displays (LCD), Plasma Display Panels (PDP), and Organic Light Emitting Display (OLED) devices, have been developed and utilized.

In order to reduce power consumption, in a low power mode or a low-speed drive mode, such display devices can be driven at a frequency lower than a frequency for driving in a normal drive mode.

For example, after the display devices have been transitioned into an off-state, while the display devices are driven in an always on display (AoD) mode for displaying specific information (e.g., time, etc.) through an area of the display pane, the display devices can be driven with a lower frequency (e.g., 30 Hz, 24 Hz, etc.) than a drive frequency (e.g., 60 Hz) in the normal drive mode.

In this case, as one frame period becomes longer in the low-speed drive mode, a width at which luminance decreases for one frame period can increase, and as a result, there occurs a problem that causes a flicker to be recognized or visible over the display panels as a difference in the luminance between frames increases.

SUMMARY

Accordingly, the present disclosure is directed to data driving circuits, display panels and display devices that substantially obviate one or more problems due to limitations and disadvantages of the background art.

Additional features and advantages of the disclosure will be set forth in the description which follows and in part will be apparent from the description, or can be learned by practice of the disclosure. The objects and other advantages of the disclosure will be realized and attained by the structure particularly pointed out in the written description and claims hereof as well as the appended drawings.

It is at least one object of the present disclosure to provide data driving circuits, display panels and display devices for preventing flickers from occurring or being recognized over display panels while the display panels are driven in a low-speed drive mode.

It is further at least one object of the present disclosure to provide data driving circuits, display panels and display devices for preventing flickers from occurring or being recognized over display panels even when conditions for driving display devices driven in the low-speed drive mode are changed.

In accordance with an aspect of the present disclosure, a display device is provided that includes a display panel including a plurality of gate lines, a plurality of data lines and a plurality of subpixels, a gate driving circuit driving the plurality of gate lines, and a date driving circuit driving the plurality of data lines.

Each of the plurality of subpixels included in the display device can include a light emitting element, a driving transistor including a first node driving the light emitting element and electrically connected to a driving voltage line, a second node that is a gate node, and a third node electrically connected to the light emitting element, and a scan transistor electrically connected between the third node and at least one of the plurality of data lines.

In addition, a data voltage is applied to the at least one data line in a first interval, and a reset voltage is applied at least once to the at least one data line in a second interval, of a frame period in the low-speed drive mode. A lowest level of a waveform of luminance of the display panel measured in the first interval can be identical to a lowest level of a waveform of luminance of the display panel measured in the second interval.

At this time, a level of the reset voltage can be set based on at least one of a driving frequency that is driven in the low-speed drive mode, luminance representing in the low-speed drive mode, or a color emitted from a subpixel to which a data voltage is applied.

In accordance with another aspect of the present disclosure, a display panel is provided that includes a plurality of gate lines, a plurality of data lines and a plurality of subpixels disposed in an area defined by intersecting of each of the gate lines GL and each of the data lines DL, and each of the plurality of subpixels can include a light emitting element, a driving transistor including a first node driving the light emitting element and electrically connected to a driving voltage line, a second node that is a gate node, and a third node electrically connected to the light emitting element, and a scan transistor electrically connected between the third node and at least one of the plurality of data lines. A data voltage is applied to the at least one data line in a first interval, and a reset voltage is applied periodically at least once to the at least one data line in a second interval, of a frame period in the low-speed drive mode. A lowest level of a waveform of luminance of the display panel measured in the first interval can be identical to a lowest level of a waveform of luminance of the display panel measured in the second interval.

In accordance with further another aspect of the present disclosure, a data driving circuit is provided that includes: a data voltage output unit outputting a data voltage to a data line in a first interval of a frame period, and a reset voltage output unit outputting periodically at least once a reset voltage to the data line in a second interval after the first interval of the frame period in the low-speed drive mode. A level of the reset voltage can be set based on at least one of a driving frequency that is driven in the low-speed drive mode, luminance caused by the data voltage, or a color emitted from a subpixel to which the data voltage is applied.

In accordance with embodiments of the present disclosure, it is possible to prevent flickers from occurring or being recognized in the low-speed drive mode by periodically supplying a reset voltage to a subpixel during a holding interval of a period in which the display device is driven in the low-speed drive mode.

In accordance with embodiments of the present disclosure, it is possible to prevent flickers from occurring or being recognized in the low-speed drive mode even when a condition for driving a display device driven in the low-speed drive mode is changed by periodically supplying, during a holding interval in the low-speed drive mode, a reset voltage set based on at least one of a driving frequency of a display device driven in the low-speed drive mode, luminance caused by a data voltage, or a color emitted from a subpixel.

DETAILED DESCRIPTION OF THE EMBODIMENTS

Figure 1:
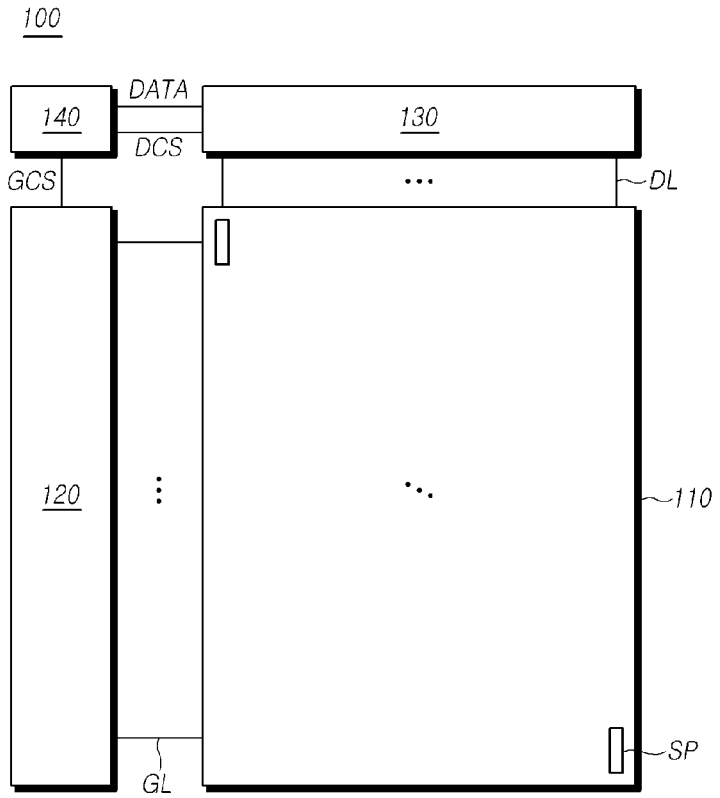
FIG. 1 is a block diagram illustrating a display device according to embodiments of the present disclosure.

Hereinafter, the present preferred embodiments of the disclosure will be described in detail with reference to the accompanying drawings. In denoting elements of the drawings by reference numerals, the same elements will be referenced by the same reference numerals although the elements are illustrated in different drawings. In the following description of the disclosure, detailed description of known functions and configurations incorporated herein can be omitted when it can make the subject matter of the disclosure rather unclear.

Terms, such as first, second, A, B, (a), or (b) can be used herein to describe elements of the disclosure. Each of the terms is not used to define essence, order, sequence, or number of an element, but is used merely to distinguish the corresponding element from another element. When it is mentioned that an element is "connected" or "coupled" to another element, it should be interpreted that another element can be "interposed" between the elements or the elements can be "connected" or "coupled" to each other via another element as well as that one element is directly connected or coupled to another element.

FIG. 1 is a block diagram illustrating a display device 100 according to embodiments of the present disclosure. All the components of the display device according to all embodiments of the present disclosure are operatively coupled and configured.

Referring to FIG. 1, the display device according to embodiments of the present disclosure 100 can include a display panel 110 including a plurality of subpixels SP, a gate driving circuit 120, a data driving circuit 130 and a controller 140, for driving the display panel 110.

A plurality of data lines DL and a plurality of gate lines GL are arranged in the display panel 110, and the plurality of subpixel SP is disposed in an area defined by intersecting of the data lines DL and the gate lines GL.

The gate driving circuit 120 is controlled by the controller 140, and sequentially outputs scan signals to the plurality of gate lines GL arranged in the display panel 110 for controlling driving timings of the subpixels.

The gate driving circuit 120 can output a scan signal for controlling a driving timing of at least one of the subpixels, and a light-emitting signal for controlling a light-emitting timing of at least one of the subpixels. In this case, a circuit for outputting the scan signal and a circuit for outputting the light-emitting signal can be implemented separately from each other, or implemented in one circuit together.

The gate driving circuit 120 can include one or more gate driver integrated circuits GDIC. The gate driving circuit 120 can be located on one side or both sides of the display panel 110, such as, a left or right side, a top or bottom side, the left and right sides, or the top and bottom sides, according to a driving scheme.

Each gate driver integrated circuit GDIC can be connected to a pad, such as a bonding pad, of the display panel 110 in a tape automated bonding (TAB) type or a chip on glass (COG), or be directly disposed on the display panel 110 in a gate in panel (GIP) type. In some instances, the gate driver integrated circuit GDIC can be disposed to be integrated into the display panel 110. Each gate driver integrated circuit GDIC can be implemented in a chip on film (COF) type, which is mounted on a film connected to the display panel 110.

The data driving circuit 130 receives image data from the controller 140 and then converts the received image data into analog data voltages. The data driving circuit 130 outputs a data voltage to each data line DL by matching a timing at which the scan signal is applied through the gate line GL, and enables each subpixel SP to emit a color in accordance with the image data.

The data driving circuit 130 can include one or more source driver integrated circuits SDIC.

Each source driver integrated circuit SDIC can include a shift register, a latch circuit, a digital to analog converter DAC, an output buffer, or the like.

Each source driver integrated circuit SDIC can be connected to a pad, such as a bonding pad, of the display panel 110 in the tape automated bonding (TAB) type or the chip on glass (COG), or be directly disposed on the display panel 110. In some instances, the source driver integrated circuit SDIC can be disposed to be integrated into the display panel 110. Each source driver integrated circuit SDIC can be implemented in a chip on film (COF) type. In this case, the source driver integrated circuit SDIC can be mounted on a film connected to the display panel 110, and be electrically connected to the display panel 110 through lines on the film.

The controller 140 provides several control signals to the gate driving circuit 120 and the data driving circuit 130, and controls operations of the gate driving circuit 120 and the data driving circuit 130.

The controller 140 can be mounted on a printed circuit board (PCB), a flexible printed circuit (FPC), etc. and be electrically connected to the gate driving circuit 120 and the data driving circuit 130 through the printed circuit board (PCB), flexible printed circuit (FPC), etc.

The controller 130 enables the gate driving circuit 120 to output a scan signal according to a timing processed in each frame, converts image data input from external devices or image providing sources to a data signal form used in the data driving circuit 130, and then outputs image data resulted from the converting to the data driving circuit 13.

The controller 140 receives, along with the image data, several types of timing signal including a vertical synchronous signal Vsync, a horizontal synchronous signal Hsync, an input data enable DE signal, a clock signal CLK, etc. from other devices, networks, or systems (e.g., a host system).

The controller 140 can generate several types of control signal using the received timing signals, and output the generated signals to the gate driving circuit 120 and the data driving circuit 130.

For example, to control the gate driving circuit 120, the controller 140 outputs several types of gate control signal GCS including a gate start pulse GSP, a gate shift clock GSC, a gate output enable signal GOE, and the like.

Here, the gate start pulse GSP is used for controlling a start timing for operating one or more gate driver integrated circuits GDIC constituting the gate driving circuit 120. The gate shift clock GSC is a clock signal commonly inputted to one or more gate driver integrated circuits GDIC, and is used for controlling a shift timing of a scan signal. The gate output enable signal GOE is used for indicating timing information of one or more gate driver integrated circuits GDIC.

In addition, to control the data driving circuit 130, the controller 140 outputs several types of data control signal DCS including a source start pulse SSP, a source sampling clock SSC, a source output enable signal SOE, and the like.

Here, the source start pulse SSP is used for controlling a data sampling start timing of one or more source driver integrated circuits SDIC constituting the data driving circuit 130. The source sampling clock SSC is a clock signal for controlling a sampling timing of data in each source driving integrated circuit SDIC. The source output enable signal SOE is used for controlling an output timing of the data driving circuit 130.

The display device 100 can supply several types of voltage or current to the display panel 110, the gate driving circuit 120, and the data driving circuit 130 etc., or can further include a power management integrated circuit for controlling the several types of voltage or current to be supplied.

Each subpixel SP is defined at an intersection of each of the gate lines GL and each of the data lines DL. According to types of display device 100, a liquid crystal composition or a light-emitting element can be disposed in the subpixel SP.

Figure 2:
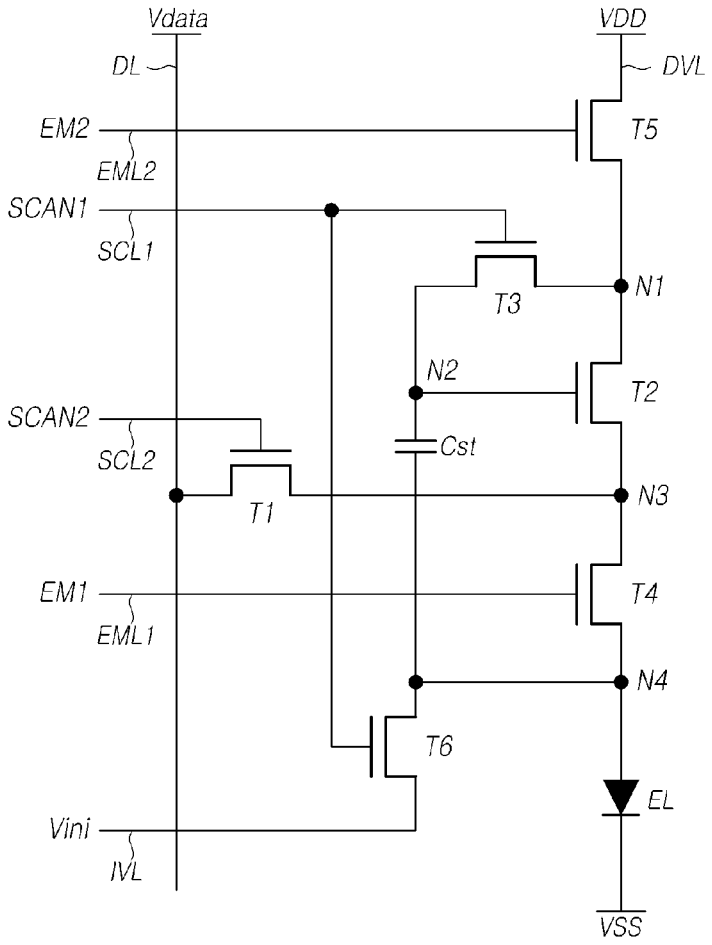
FIG. 2 is a schematic circuit diagram of a subpixel disposed in the display device according to embodiments of the present disclosure.

FIG. 2 is a schematic circuit diagram of a subpixel SP disposed in the display device 100 according to embodiments of the present disclosure.

Referring to FIG. 2, the subpixel SP of the display device 100 according to embodiments of the present disclosure can include, e.g., a light-emitting element EL, a plurality of transistors T1 to T6 for driving the light-emitting element EL, and at least one capacitor Cst.

For example, FIG. 2 shows an example subpixel configured with six transistors and one capacitor (6T-1C); however, embodiments of the present disclosure are not limited thereto. Circuit elements disposed in the subpixel SP can be implemented in various designs according to types of display device 100.

In addition, FIG. 2 shows that n-type transistors are disposed in the subpixel SP, but in some instances, p-type transistors can be disposed in the subpixel.

In case the subpixel SP is configured with the 6T-1C structure, the 6 transistors T1 to T6 and the 1 capacitor Cst can be disposed in each subpixel SP.

A first transistor T1 is controlled by a second scan signal SCAN2 supplied through a second scan line SCL2, and can be electrically connected between a data line DL to which a data voltage is applied and a third node N3. Such a first transistor T1 can be referred to as a scan transistor.

A second transistor T2 can have a first node N1, and a second node N2 and the third node N3. The first node N1 can be a drain node or a source node, and be electrically connected to a driving voltage line DVL to which a driving voltage VDD is applied. The second node N2 can be a gate node. The third node N3 can be the source node or the drain node, and be electrically connected to an anode electrode of the light-emitting element EL. Such a second transistor T2 can be referred to as a driving transistor.

A third transistor T3 is controlled by a first scan signal SCAN1 supplied through a first scan line SCL1, and can be electrically connected between the first node N1 and the second node N2 of the second transistor T2. Such a third transistor T3 can be referred to as a compensation transistor.

A fourth transistor T4 is controlled by a first light-emitting signal EM1 supplied through a first light-emitting control line EML1, and can be electrically connected between the third node N3 and a fourth node N4. Such a fourth transistor T4 can be referred to as a first light-emitting transistor.

A fifth transistor T5 is controlled by a second light-emitting signal EM2 supplied through a second light-emitting control line EML2, and can be electrically connected between the first node N1 and the driving voltage line DVL. Such a fifth transistor T5 can be referred to as a second light-emitting transistor.

A sixth transistor T6 is controlled by the first scan signal SCAN1 supplied through the first scan line SCL1, and can be electrically connected between the fourth node N4 and an initialization voltage line IVL. Such a sixth transistor T6 can be referred to as an initialization transistor.

A capacitor Cst is connected between the second node N2 and the fourth node N4, and can maintain a data voltage Vdata for a time period of one frame.

The light-emitting element EL is electrically connected between the fourth node N4 and a line to which a low voltage VSS is applied. The light-emitting element EL can be, e.g., an organic light emitting diode OLED, etc.

Figure 3:
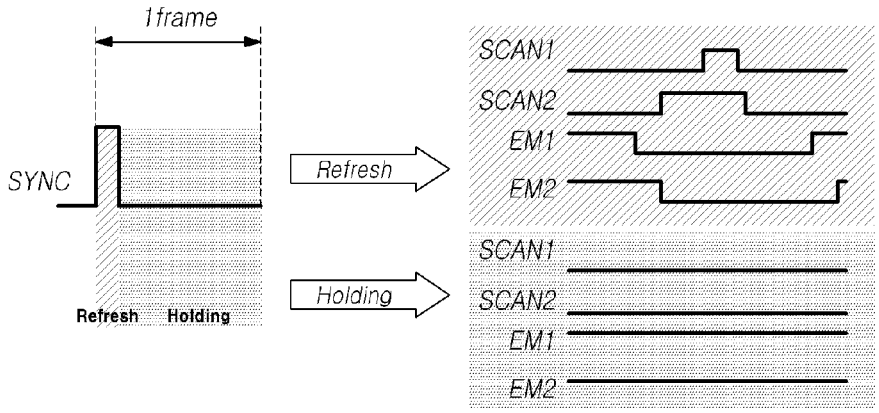
FIG. 3 is a timing chart for driving the subpixel shown in FIG. 2.

FIG. 3 shows a timing chart for driving the subpixel shown in FIG. 2 according to embodiments of the present disclosure.

Referring to FIG. 3, one frame period can be divided into a refresh interval (or a first interval) and a holding interval (or a second interval), which are in sync with a synchronization signal SYNC.

A data voltage Vdata and an initialization voltage Vini for driving the subpixel SP can be applied to the subpixel SP in the refresh interval.

Specifically, in the refresh interval, in a state where the first light-emitting signal EM1 and the second light-emitting signal EM2 are applied with a low level, the first scan signal SCAN1 and the second scan signal SCAN2 can be applied with a high level.

Since the first light-emitting signal EM1 and the second light-emitting signal EM2 are applied with the low level, the fourth transistor T4 and the fifth transistor T5 is turned off.

Since the first scan signal SCAN1 is applied with the high level, the third transistor T3 and the sixth transistor T6 become turned on. Since the second scan signal SCAN2 is applied with the high level, the first transistor T1 becomes turned on.

Here, discussion is conducted on the case where the second scan signal SCAN2 is applied with the high level at an earlier time than the first scan signal SCAN1, but in some instances, the first scan signal SCAN1 can be applied with the high level at an earlier time than the second scan signal SCAN2.

Since the first transistor T1 is turned on, a data voltage Vdata can be applied to the third node N3. Since the third transistor T3 is turned on, the data voltage Vdata applied to the third node N3 is applied to the second node N2 through the first node N1.

At this time, a voltage obtained by subtracting a threshold voltage of the second transistor T2 from the data voltage Vdata can be applied to the second node N2, and thus, it is possible to compensate the threshold voltage of the second transistor T2.

In addition, since the initialization voltage *Vini* is applied to the fourth node N4 by the turn-on of the sixth transistor T6, thus the data voltage Vdata and the initialization voltage *Vini* become applied to both ends of the capacitor Cst.

In the holding interval after the refresh interval, the light-emitting element can emit light according to data voltages Vdata applied to the subpixel SP.

Specifically, in the holding interval, the first scan signal SCAN1 and the second scan signal SCAN2 can be applied with a low level, and the first light-emitting signal EM1 and the second light-emitting signal EM2 can be applied to with a high level.

Since the first scan signal SCAN1 and the second scan signal SCAN2 are applied with the low level, the fourth transistor T3 and the fifth transistor T6 become turned off.

Since the first light-emitting signal EM1 and the second light-emitting signal EM2 are applied with the high level, the fourth transistor T4 and the fifth transistor T5 become turned on.

Here, since the data voltage Vdata has been applied to the second node N2 which is the gate node of the second transistor T2, the light-emitting element EL can be driven by a current flowing through the second transistor T2 and corresponding to the data voltage Vdata, and represent brightness in accordance with the data voltage Vdata.

For example, the initialization and the application of the data voltage Vdata can be performed in the refresh interval of one frame period, and light-emitting of the light-emitting element can be performed in the holding interval of one frame period.

At this time, the length of the holding interval of one frame period can be larger when the display device 100 is driven in a low-speed drive mode to reduce power consumption. Further, a width corresponding to a degree to which the luminance of the subpixel SP is decreased for one frame period can become larger, as the holding interval becomes larger.

Figure 4:
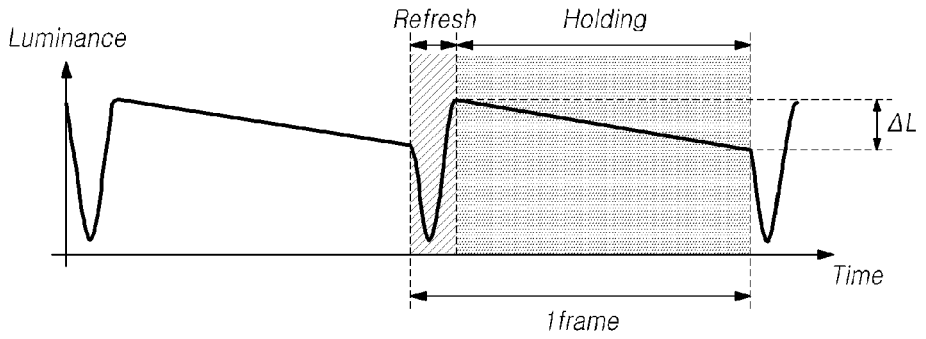
FIG. 4 is a plot showing a variance in luminance representing in the low-speed drive mode when the subpixel is driven according to the timing shown in FIG. 3.

FIG. 4 is a plot showing a variance in luminance representing in the low-speed drive mode when the subpixel SP is driven according to the timing shown in FIG. 3.

Referring to FIG. 4, in the refresh interval, the luminance of the subpixel SP can be instantaneously lowered because the data voltage Vdata and the initialization voltage *Vini* are applied in the state where the fourth transistor T4 and the fifth transistor T5 is turned off.

Further, the light-emitting element starts light-emitting, when the initialization and the application of the data voltage Vdata have been performed, and the fourth transistor T4 and the fifth transistor T5 become turned on, and therefore luminescence of the subpixel SP can increase.

Thereafter, in the holding interval, the luminescence of the subpixel SP can gradually decrease, and when the subpixel SP is driven in the low-speed drive mode, a width $\Delta L$ corresponding to a degree to which the luminance of the subpixel SP is decreased for the holding interval can become larger because a length of the holding interval becomes larger.

Accordingly, when the subpixel SP is driven in the low-speed drive mode, a difference in luminance between frames increases, and therefore there is a problem that a flicker can be recognized due to the difference in luminance.

In accordance with embodiments of the present disclosure, when the display device 100 is driven in the low-speed drive mode, it is possible to prevent flickers from occurring or being recognized over the display panel 110 by periodically supplying a specific voltage to the subpixel SP in the holding interval.

Figure 5:
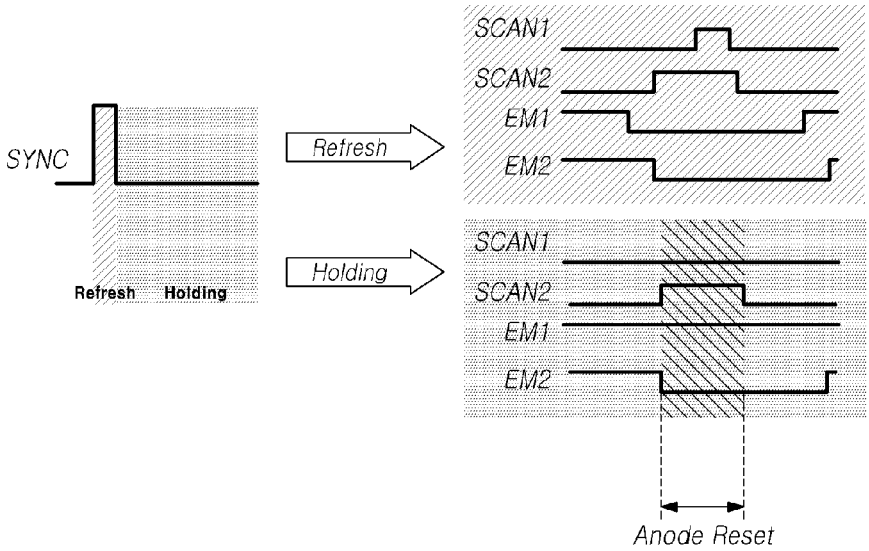
FIG. 5 is a timing chart of another example for driving the subpixel shown in FIG. 2.

FIG. 5 shows another example of driving timing of the subpixel shown in FIG. 2.

Referring to FIG. 5, one frame period can be divided into a refresh interval and a holding interval in sync with a synchronization signal SYNC, and in the refresh interval, a data voltage Vdata and an initialization voltage *Vini* can be applied to the subpixel SP for driving the subpixel SP.

A driving scheme in the refresh interval can be similar or identical to the driving scheme in the refresh interval discussed through FIG. 3.

Further, in the holding interval, a first scan signal SCAN1 and a second scan signal SCAN2 can be applied with a low level to the subpixel SP, and a first light-emitting signal EM1 and a second light-emitting signal EM2 can be applied with a high level to the subpixel SP. Accordingly, a light-emitting element disposed in the subpixel SP can emit light.

At this time, a reset voltage Vrst can be periodically applied for resetting an anode electrode of the light-emitting element EL through a data line DL for the holding interval.

Specifically, in the holding interval, the second scan signal SCAN2 is applied with a high level, and the second light-emitting signal EM2 is applied with a low level, for an interval in which the anode electrode of the light-emitting element EL is reset.

For example, levels of the second scan signal SCAN2 and the second light-emitting signal EM2 can be changed in a state where the first scan signal remains with the low level and the first light-emitting signal remains with the high level.

In addition, in an interval where the second scan signal SCAN2 is applied with the high level, a reset voltage Vrst can be applied through the data line DL.

The first transistor T1 and the fourth transistor T4 become turned on because the second scan signal SCAN2 and the first light-emitting signal EM1 are applied with the high level.

Accordingly, the reset voltage Vrst supplied through the data line DL can be applied to the fourth node N4, i.e., the anode electrode of the light-emitting element EL, through the first transistor T1 and the fourth transistor T4.

In addition, the reset voltage is applied to the anode electrode of the light-emitting element EL for the holding interval, and therefore, the brightness of the light-emitting element EL can vary depending on the reset voltage Vrst.

Here, the reset voltage Vrst is a voltage for preventing flickers from occurring or being recognized in the low-speed drive mode, and can be therefore a voltage for enabling the luminance of the light-emitting element EL to match a level of luminance representing in the refresh interval.

In addition, the reset voltage Vrst can be supplied once every interval identical to the refresh interval for the holding interval.

For example, by enabling a waveform of luminance representing in the refresh interval to represent repeatedly in the holding interval, it is possible to prevent flickers from occurring or being recognized due to a decrease in luminance in the holding interval in the low-speed drive mode.

Figure 6:
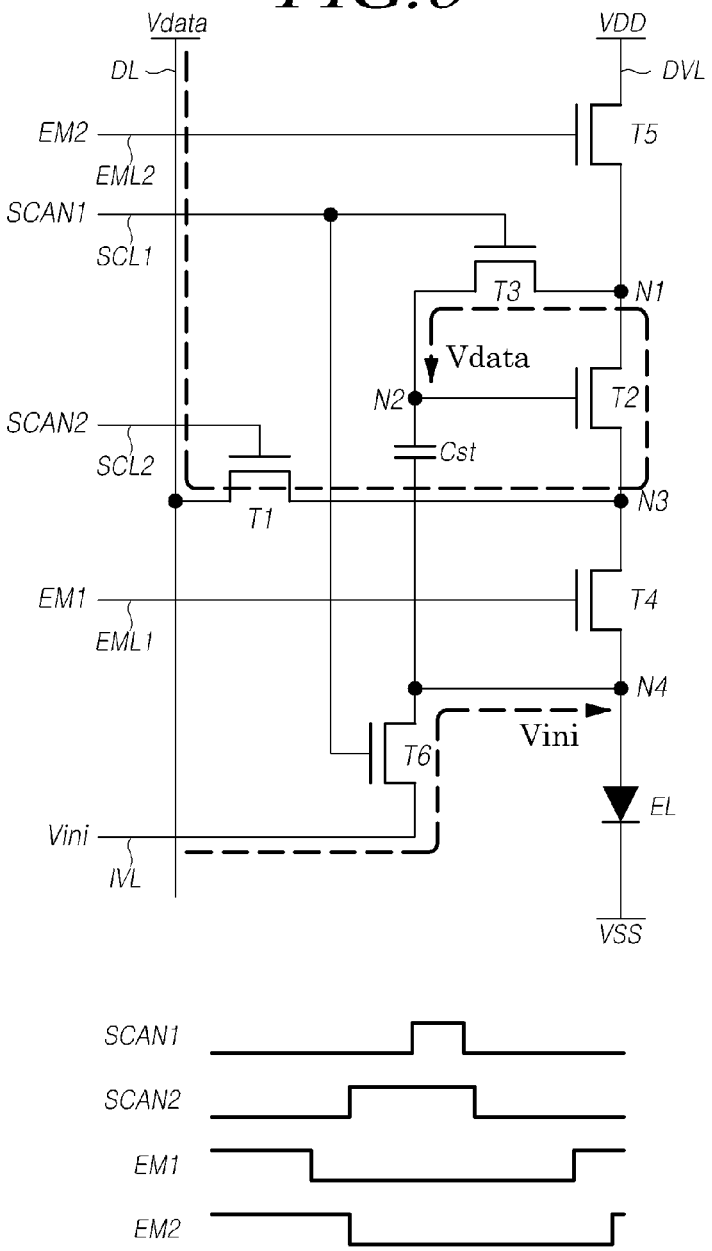
FIGS. 6 to 8 are diagrams illustrating a process of driving the subpixel according to the timing shown in FIG. 5.
Figure 7:
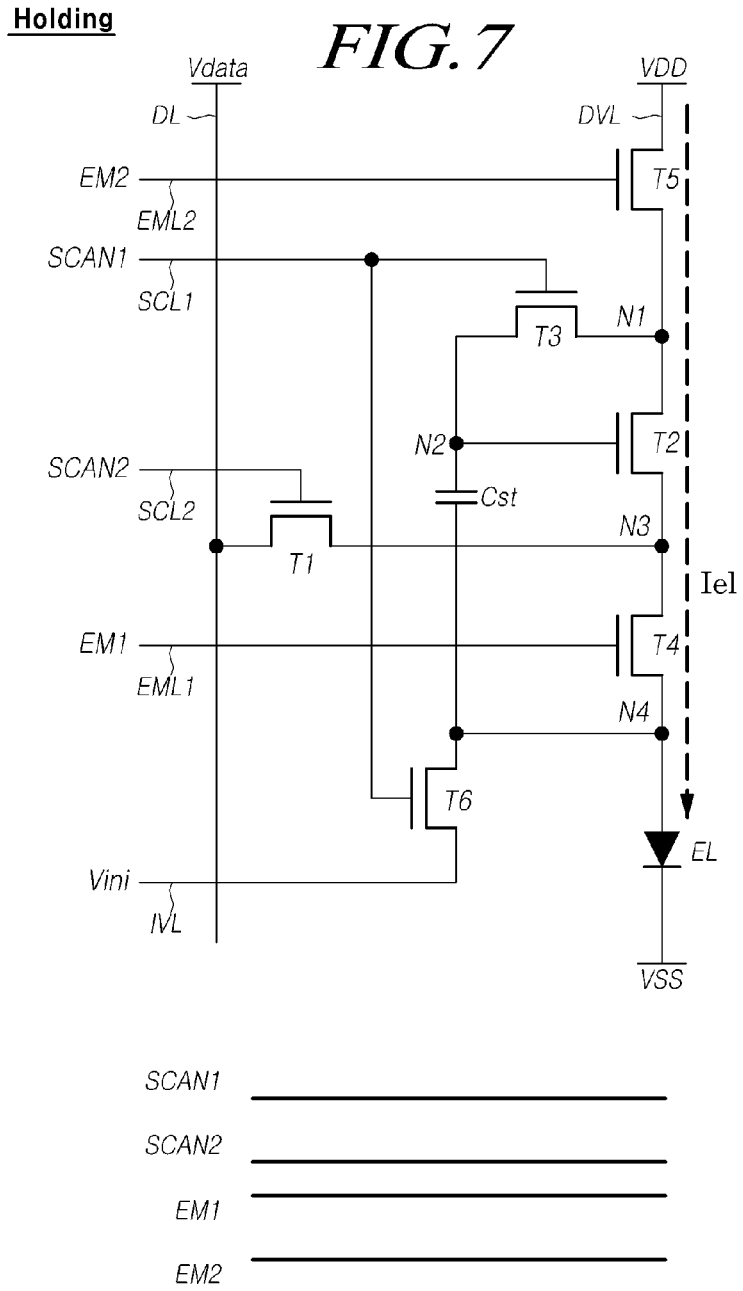
Figure 8:
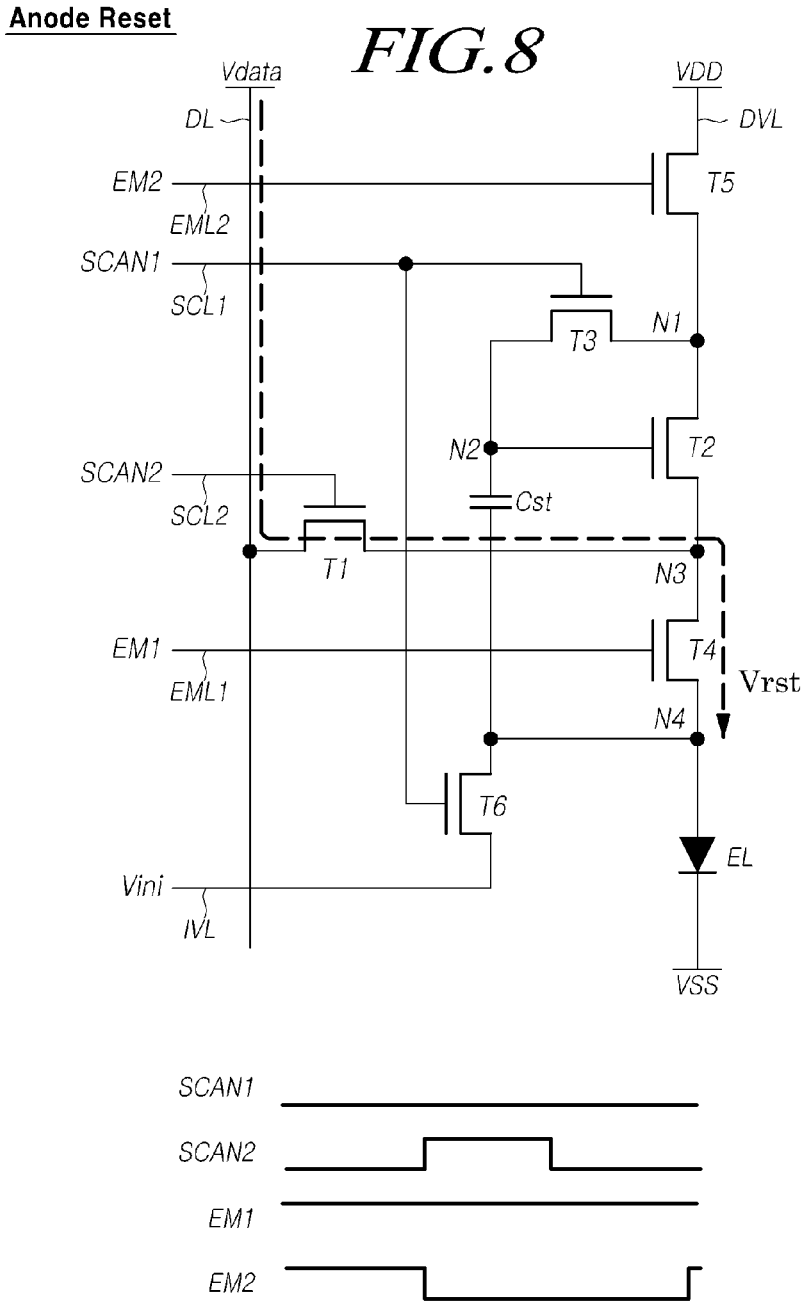

FIGS. 6 to 8 are diagrams illustrating a process of driving the subpixel according to the timing shown in FIG. 5.

More specifically, FIG. 6 shows that the subpixel SP is driven in the refresh interval in the low-speed drive mode of the display device 100.

In the refresh interval, the first scan signal SCAN1 and the second scan signal SCAN2 are applied with a high level in a state where the first light-emitting signal EM1 and the second light-emitting signal EM2 are in a low level.

In addition, in an interval where the first scan signal SCAN1 is applied with the high level, a data voltage Vdata can be supplied through the data line DL.

Accordingly, the data voltage Vdata supplied through the data line DL can be applied to the gate node, i.e., the second node N2, of the second transistor T2 that is the driving transistor.

At this time, the data voltage Vdata supplied through the data line DL can be applied to the second node N2 through the second transistor T2. Accordingly, a voltage obtained by subtracting a threshold voltage of the second transistor T2 from the data voltage Vdata can be applied to the second node N2, and thus, it is possible to compensate the threshold voltage of the second transistor T2.

In addition, an initialization voltage Vini is applied to the fourth node N4, and thus the initialization and the application of the data voltage Vdata are performed for the refresh interval.

Referring to FIG. 7, in the holding interval, the first scan signal SCAN1 and the second scan signal SCAN2 are applied with a low level, and the first light-emitting signal EM1 and the second light-emitting signal EM2 are applied with a high level.

Accordingly, the fourth T4 and the fifth transistor T5 become turned on in a state where the first transistor T1, the third transistor T3 and the sixth transistor T6 are turned off.

Further, since the data voltage Vdata has been applied to the gate node N2 of the second transistor T2, and the initialization voltage Vini has been applied to the fourth N4, a current Iel corresponding to the data voltage Vdata flows through the second transistor T2, and thus the light-emitting element EL starts to emit light.

Referring to FIG. 8, in the holding interval, in a stage where the first scan signal SCAN1 remains in the low level and the first light-emitting signal EM1 remains in the high level, the second scan signal SCAN2 can be repeatedly applied with a high level and the second light-emitting signal EM2 can be applied with a low level.

In addition, in an interval where the second scan signal SCAN2 is applied with the high level, a reset voltage Vrst can be applied through the data line DL.

The first transistor T1 and the fourth transistor T4 is turned on due to the second scan signal SCAN2 and the first light-emitting signal EM1, and therefore, the reset voltage supplied through the data line DL is applied to the fourth node N4, i.e., the anode electrode of the light-emitting element EL.

Accordingly, a level of luminance of the light-emitting element EL in the holding interval can vary, as the reset voltage Vrst is applied. In addition, as the level of luminance varies, a waveform of luminance of the light-emitting element can be identical to a waveform of luminance representing in the refresh interval, and as a result, it is possible to prevent flickers from occurring or being recognized in the holding interval in the low-speed drive mode.

Figure 9:
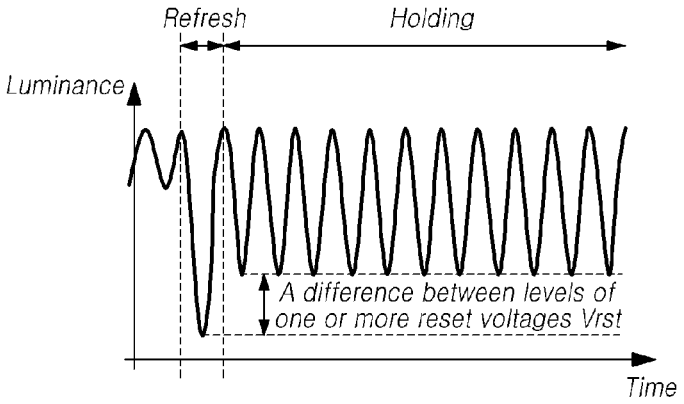
FIG. 9 is a plot showing a variance in luminance representing in the low-speed drive mode when the subpixel is driven according to the timing shown in FIG. 5.

FIG. 9 is a plot showing a variance in luminance representing in the low-speed drive mode when the subpixel SP is driven according to the timing shown in FIG. 5.

Referring to FIG. 9, since one or more reset voltages are supplied for a holding interval in the low-speed drive mode, a waveform of luminance of the light-emitting element representing in the holding interval can be identical to a waveform of luminance of the light-emitting element representing in a refresh interval.

Through this, it is possible to prevent flickers from occurring or being recognized in the holding interval in the low-speed drive mode.

At this time, as shown in FIG. 9, in some cases, there is a possibility of a difference between a lowest level of a waveform of luminance representing in the refresh interval and a lowest level of a waveform of luminance representing in the holding interval.

For example, as shown in FIG. 9, by applying one or more reset voltages Vrst in the holding interval, a waveform of luminance representing in the holding interval can have a similar form to a waveform of luminance representing in the refresh interval; however, there is a possibility of a difference between lowest levels of waveforms of luminance.

This can occur because correspondence between a flicker representing according to a driving condition of the display device 100 and an optimal reset voltage Vrst for preventing the flicker is not constant in all driving conditions, in the low-speed drive mode. For example, this can be caused by different flicker characteristics according to driving conditions.

Figure 10A:
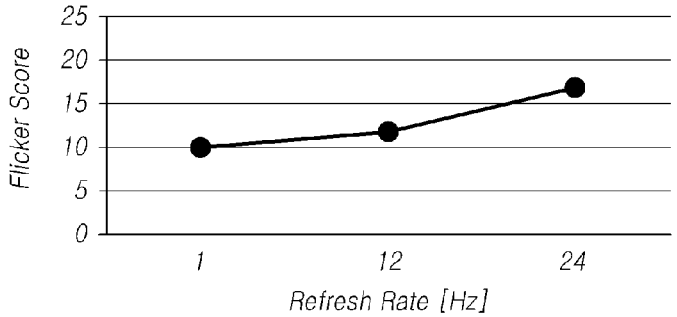
FIGS. 10A to 10C are plots showing examples of flicker scores according to conditions for driving the display device.
Figure 10B:
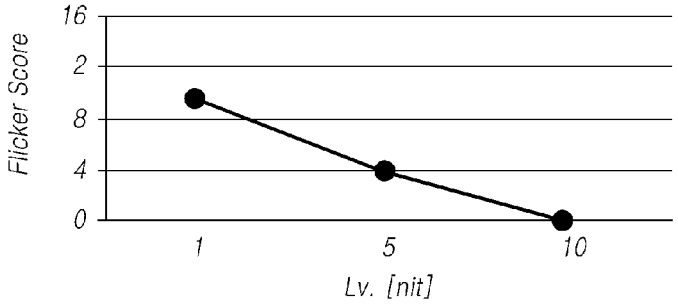
Figure 10C:
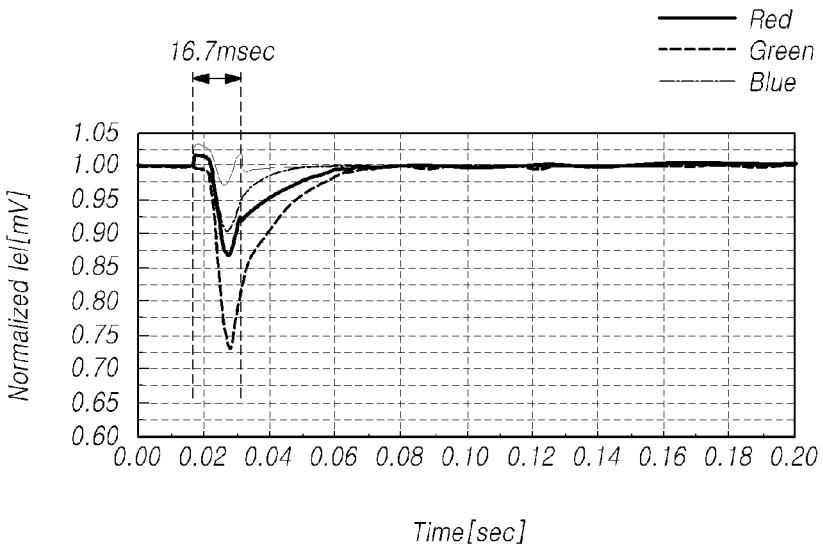

FIGS. 10A to 10C are plots showing examples of flicker scores according to conditions for driving the display device 100.

Particularly, FIG. 10A shows an example of a refresh rate of the display device 100, for example, a flicker score measured according to a driving frequency.

As shown in FIG. 10A, in the low-speed drive mode, a flicker score measured when the display device 100 is driven with a relatively high driving frequency (e.g., 24 Hz) can be higher than a flicker score measured when the display device 100 is driven with a relatively low driving frequency (e.g., 1 Hz).

FIG. 10B shows an example of a flicker score measured according to luminance of the display device 100, and a flicker score in a relatively low luminance (e.g., 1 nit) can be higher than a flicker score in a relatively high luminance (e.g., 10 nit).

Such a difference in luminance can be caused by a difference in data voltages Vdata in accordance with gray scale, or by a difference in ranges of a gamma voltage used for generating a data voltage Vdata, that is, bands.

FIG. 10C shows a flicker characteristic in accordance with a color emitted from a subpixel SP disposed in the display device 100. A width corresponding to a degree to which luminescence of a green light-emitting element EL decreases can become larger due to characteristics of electronic elements, etc. even when an identical data voltage Vdata is applied. Such a flicker characteristic in accordance with the color emitted from the subpixel SP can be exhibited similarly even when a color filter is disposed over a white light-emitting element EL.

Thus, since there is a difference in flickers representing according to a driving frequency, luminance, or a color emitted from a subpixel etc. in the low-speed drive mode, it is necessary for a reset voltage applied according to a driving condition of the display device 100 to be changed.

In accordance with embodiments of the present disclosure, one or more reset voltages are periodically supplied in the holding interval in the low-speed drive mode, and thus by supplying one or more reset voltages set based on at least one of a driving frequency, luminance, or a color emitted from a subpixel, it is possible for a waveform of luminance representing in the holding interval to be identical or substantially identical to a waveform of luminance representing in the refresh interval even when a driving condition is changed.

Accordingly, it is possible to overcome a flicker phenomenon that may occur according to driving conditions when a fixed reset voltage Vrst is supplied, and to prevent flickers from occurring or being recognized in various driving conditions in the low-speed drive mode.

Figure 11:
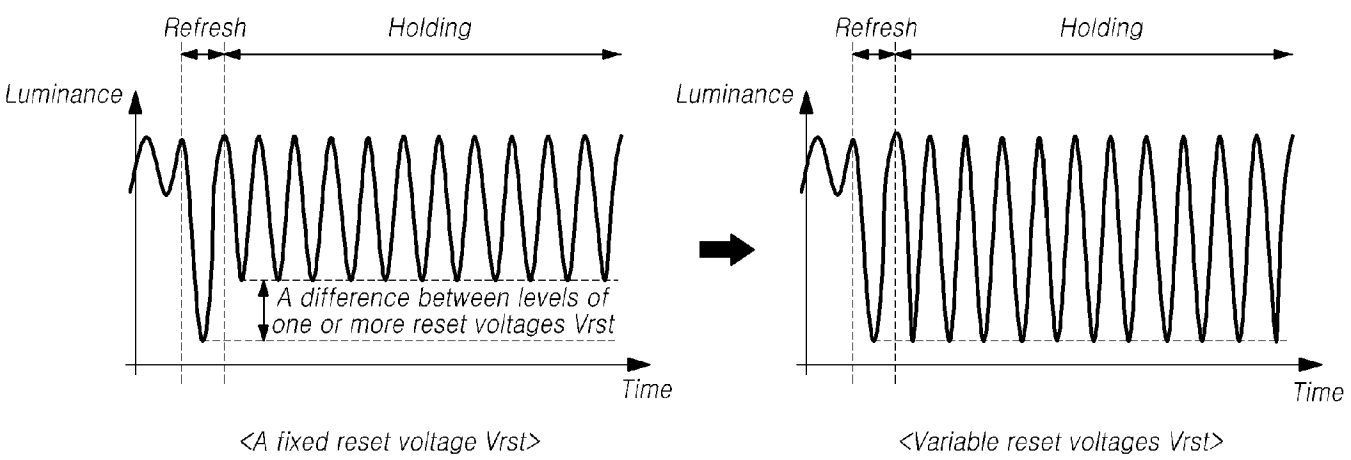
FIG. 11 is a plot showing a variance in luminance representing in the low-speed drive mode in case supplied are one or more reset voltages set according to a driving condition when the subpixel is driven according to the timing shown in FIG. 5.

FIG. 11 is a plot showing a variance in luminance representing in the low-speed drive mode in case supplied are one or more reset voltages Vrst set according to a driving condition when the subpixel is driven according to the timing shown in FIG. 5.

Referring to FIG. 11, in the display device 100 according to embodiments of the present disclosure, one or more reset voltages are periodically supplied to the anode electrode of the light-emitting element EL in the holding interval in the low-speed drive mode.

Accordingly, a waveform of luminance representing in the holding interval can be similar or substantially identical to a waveform of luminance representing in the refresh interval.

At this time, when a reset voltage Vrst supplied in the holding interval is a fixed voltage, a lowest level of a waveform of luminance representing in the holding interval according to a driving condition can be different from a lowest level of a waveform of luminance representing in the refresh interval, for example, there occurs a difference between them.

On the contrary, when the reset voltage Vrst supplied in the holding interval is variable voltages in accordance with a driving condition of the display device 100, such as, a driving frequency, luminance, or a color emitted from a subpixel SP etc., it is possible for a lowest level of a waveform of luminance representing in the holding interval to be identical or substantially identical to a lowest level of a waveform of luminance representing in the refresh interval even when the driving condition is changed.

Accordingly, while the display device 100 is driven in the low-speed drive mode, by supplying one or more reset voltage Vrst that are set according to a driving condition, it is possible to overcome a flicker phenomenon in various driving conditions in the low-speed drive mode, and improve further display quality of images in the low-speed drive mode.

Figure 12:
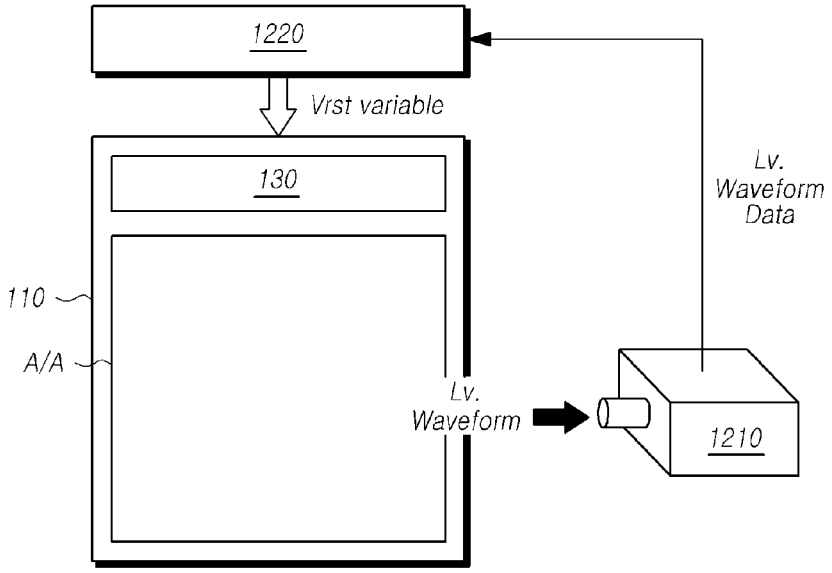
FIG. 12 is a diagram illustrating a system for setting a reset voltage according to a driving condition of the display device in accordance with embodiments of the present disclosure.

FIG. 12 is a diagram illustrating a system for setting one or more reset voltages Vrst according to a driving condition of the display device 100 in accordance with embodiments of the present disclosure.

Referring to FIG. 12, the setting of a reset voltage Vrst for overcoming a flicker phenomenon in the low-speed drive mode can be performed with, e.g., an optical sensing device 1210 and an optical compensation logic 1220.

The optical sensing device 1210 can measure a waveform of luminance of the display panel 110, and provide the measured waveform to the optical compensation logic 1220.

The setting of a reset voltage Vrst can be performed such that the optical compensation logic 1220, e.g., an optical compensation software, drives the display panel 110 according to a driving condition for optically compensating the luminance of the display panel 110.

Further, the optical compensation logic 1220 can drive the display panel 110 by changing a reset voltage Vrst depending on a waveform of luminance that is received from the optical sensing device 1210.

In case a waveform of luminance received from the optical sensing device 1210 is identified as a waveform of luminance capable of overcoming a flicker, the optical compensation logic 1220 sets a corresponding reset voltage Vrst that causes the waveform of luminance to be represented as a reset voltage Vrst in the corresponding driving condition.

The optical compensation logic 1220 sets reset voltages Vrst according to driving conditions by changing a driving condition, and stores the reset voltages Vrst set according to the driving conditions in the driving circuit 130.

Accordingly, the data driving circuit 130 resets the anode electrode of the light-emitting element EL in the holding interval in the low-speed drive mode, using the reset voltages set according to the driving conditions of the display device 100. Thus it is possible to overcome the flicker phenomenon through an optimized reset voltage in various driving conditions.

Figure 13A:
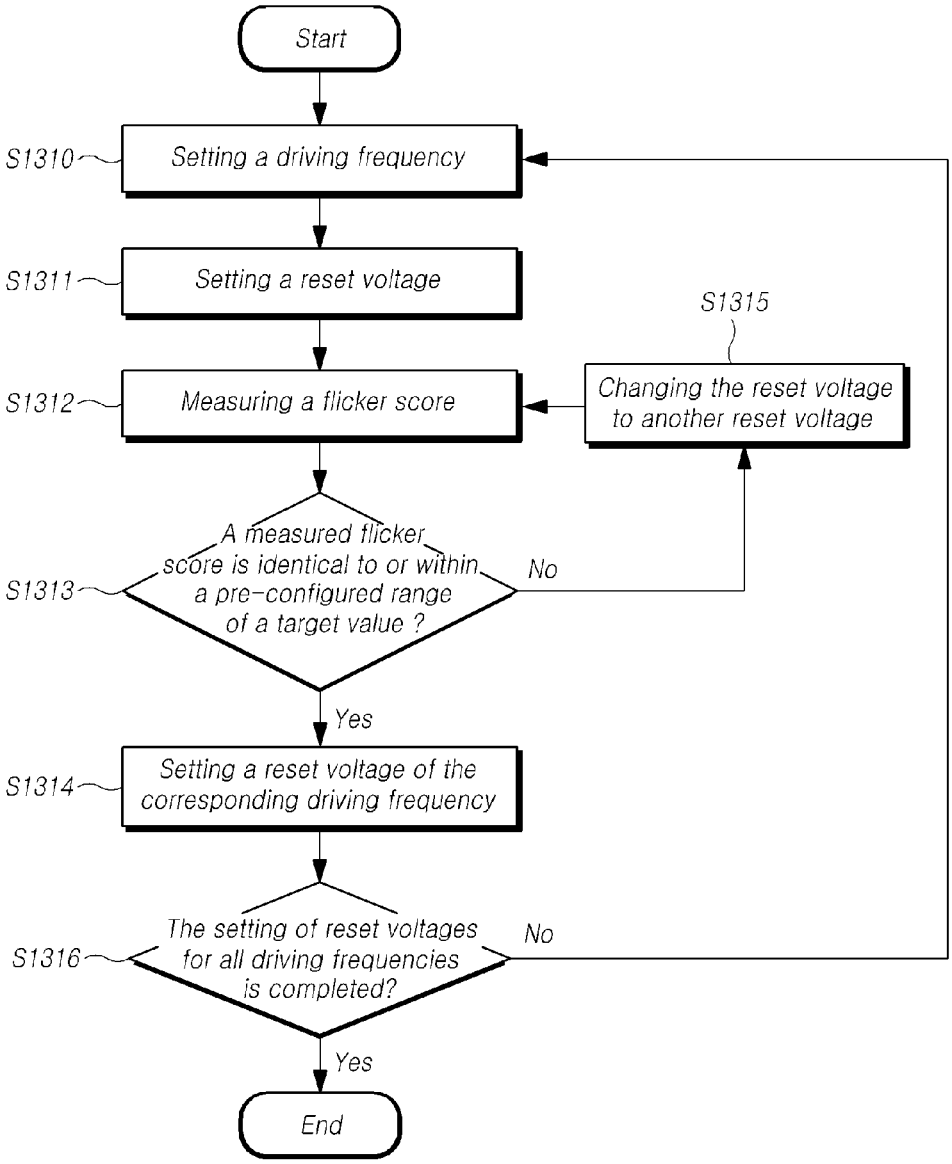
FIGS. 13A and 13B are flow charts illustrating processes of setting the reset voltage by the system shown in FIG. 12.
Figure 13B:
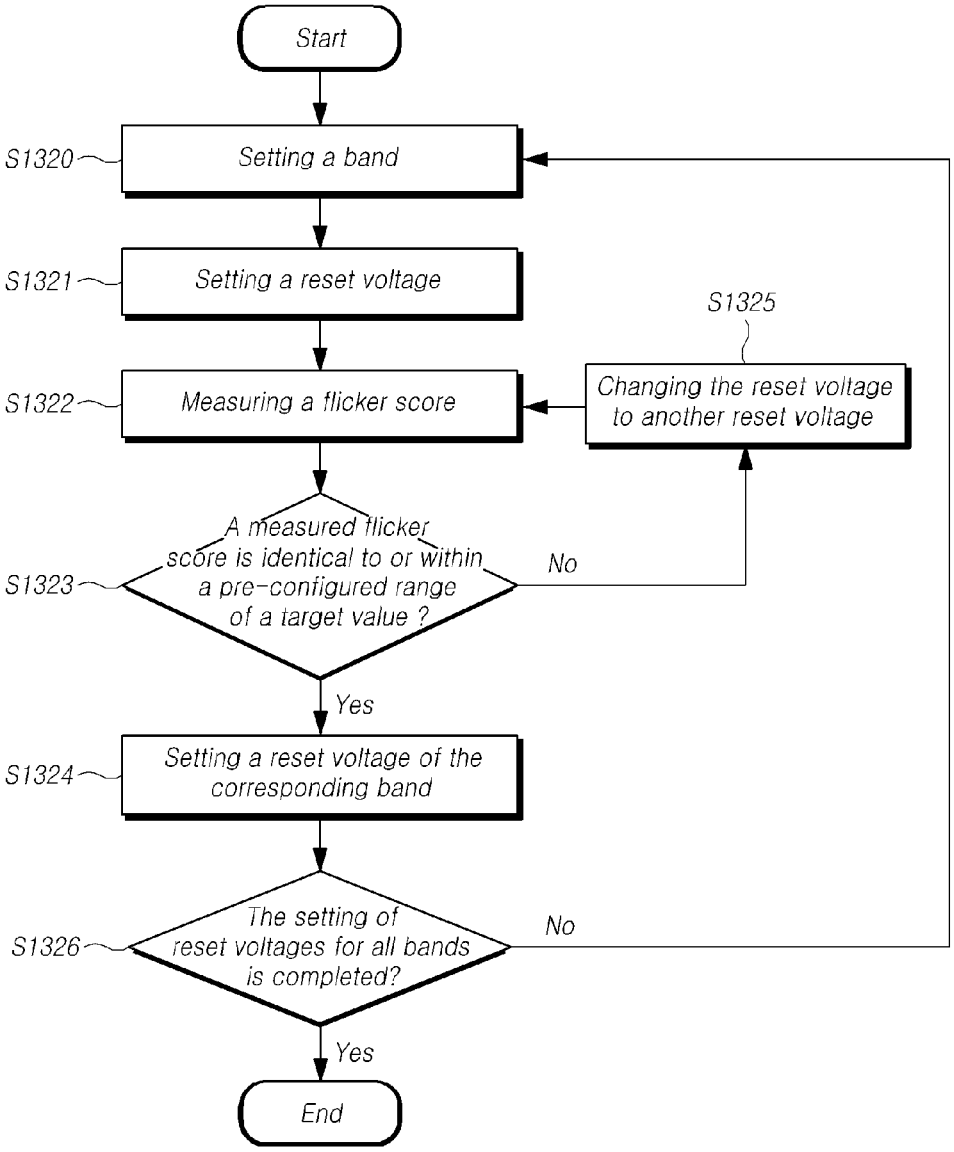

FIGS. 13A and 13B are flow charts illustrating processes of setting the reset voltage Vrst by the system shown in FIG. 12.

FIG. 13A shows that the optical compensation logic 1220 sets a reset voltage Vrst according to a driving frequency in the low-speed drive mode.

The optical compensation logic 1220 sets a driving frequency of the display device 100, at step S1310, and sets one of one or more candidate reset voltages Vrst for the driving frequency as a corresponding reset voltage, at step S1311.

Here, the setting of one or more reset voltages Vrst can be performed according to data voltages Vdata supplied to the display panel 110 in respective driving frequencies, for example, gray scale.

Further, the optical compensation logic 1220 measures a flicker score representing from the display panel 110 based on a waveform of luminance received from the optical sensing device 1210, at step S1312.

When the measured flicker score is identical to or within a pre-configured range of a target value, at step S1313, the optical compensation logic 1220 sets the reset voltage used for the measurement as a reset voltage Vrst for the corresponding driving frequency, at step S1314.

When the measured flicker score is beyond the pre-configured range of the target value, the optical compensation logic 1220 changes the reset voltage Vrst to another reset voltage, at step S1315, and then performs the measurement of the flicker score and the comparing with the target value again.

When one or more reset voltages have been set for all driving frequencies required to set reset voltages Vrst, at step S1316, the optical compensation logic 1220 completes the process for setting the reset voltage(s).

FIG. 13B shows that the optical compensation logic 1220 sets a reset voltage Vrst according to luminance in the low-speed drive mode.

The optical compensation logic 1220 sets a band that means a range of a gamma voltage for driving the display panel 110, at step S1320, and sets a reset voltage for the band, at step S1321.

Here, the reset voltage Vrst can be set according to a data voltage Vdata supplied to the display panel 110 in the corresponding band, for example, gray scale.

The optical compensation logic 1220 measures a flicker score based on a waveform of luminance received from the optical sensing device 1210, at step S1322, and compares the measured flicker score with a target value, at step S1323.

When the measured flicker score is identical to or within a pre-configured range of a target value, the optical compensation logic 1220 sets the reset voltage used for the measurement as a reset voltage Vrst for the corresponding driving frequency, at step S1324.

When the measured flicker score is beyond the pre-configured range of the target value, the optical compensation logic 1220 changes the reset voltage Vrst to another reset voltage, at step S1325, and then performs the measurement of the flicker score and the comparing with the target value again.

When one or more reset voltages have been set for all driving frequencies required to set reset voltages Vrst, at step S1326, the optical compensation logic 1220 completes the process for setting the reset voltage(s).

In addition, the setting of one or more reset voltages Vrst according to a color emitted from a subpixel SP can be performed in a process similar to the processes described above.

As described above, through the optical compensation logic 1220, one or more reset voltages Vrst set per at least one of a driving frequency, a band, or a color emitted from the subpixel SP can be stored in the data driving circuit 130, and optimal reset voltages Vrst according to driving conditions can be used in case the display device 100 is driven in the low-speed drive mode.

Figure 14:
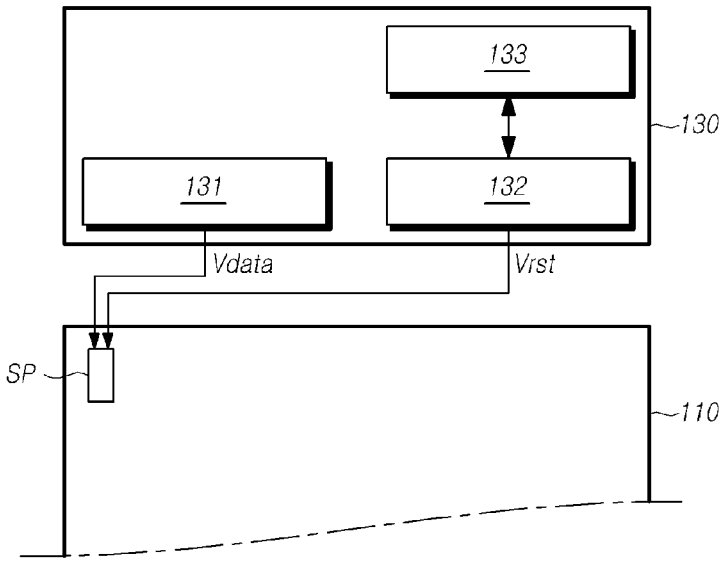
FIG. 14 is a block diagram illustrating a data driving circuit according to embodiments of the present disclosure.

FIG. 14 is a flow chart illustrating a method of driving the data driving circuit 130 according to embodiments of the present disclosure.

Referring to FIG. 14, the data driving circuit 130 can include a data voltage output unit 131, a reset voltage output unit 133 and a memory 133.

The data voltage output unit 131 outputs data voltages Vdata corresponding to image data received from a controller 140 in a refresh interval of one frame period.

The data voltage output unit 131 can output data voltages Vdata in each of the normal drive mode and the low-speed drive mode and in a driving method similar to each other.

The reset voltage output unit 132 periodically outputs one or more reset voltages to a holding interval of a period in which the display device 100 is driven in the low-speed drive mode.

Such a reset voltage output unit 132 dose not output a reset voltage Vrst in a period in which the display device 100 is driven in the normal drive mode, but outputs one or more reset voltages Vrst in only a period in which the display device 100 is driven in the low-speed drive mode.

The reset voltage output unit 132 can identify one or more reset voltages Vrst set according to driving conditions of the display device 100 stored in the memory 133, and then output a changed reset voltage.

For example, after the reset voltage output unit 132 has identified, from the memory 133, one or more reset voltages Vrst set based on at least one of a driving frequency in the low-speed drive mode, luminance representing according to a data voltage Vdata output from the data voltage output unit 131, or a color emitted from a subpixel to which the data voltage Vdata is supplied, the reset voltage output unit 132 can output a corresponding reset voltage to the display panel 110.

Accordingly, since one or more reset voltages set according to driving conditions of the display device 100 are supplied, it is therefore possible for a lowest level of a waveform of luminance in the holding interval in the low-speed drive mode to be identical or substantially identical to a lowest level of a waveform of luminance representing in the refresh interval even when a driving condition is changed.

Figure 15:
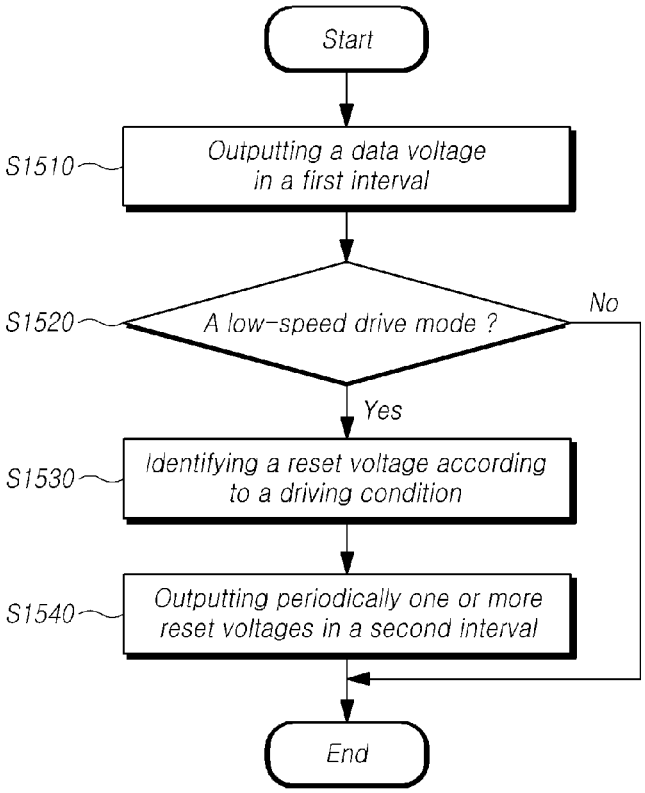
FIG. 15 is a flow chart illustrating a method of driving the data driving circuit according to embodiments of the present disclosure.

FIG. 15 is a flow chart illustrating a method of driving the data driving circuit 130 according to embodiments of the present disclosure.

Referring to FIG. 15, the data driving circuit 130 outputs a data voltage Vdata in a first interval, i.e., a refresh interval of one frame period, at step S1510.

Thereafter, when the display device 100 is driven in the low-speed drive mode, at step S1520, the data driving circuit 130 identifies a reset voltage in accordance with a driving condition, at step S1530.

The data driving circuit 130 periodically outputs one or more reset voltages Vrst that is set in accordance with one or more driving conditions in a second interval, i.e., a holding interval, at step S1540. Therefore, it is possible to prevent flickers from occurring or being recognized in the low-speed drive mode.

In accordance with embodiments of the present disclosure, when the display device 100 is driven in the low-speed drive mode, it is possible to prevent flickers from occurring or being recognized in the low-speed drive mode by periodically supplying one or more reset voltages for resetting the anode electrode of the light-emitting element EL supplying in the holding interval.

In addition, since supplied are one or more reset voltages Vrst independently set according to a driving condition of the display device 100, such as, a driving frequency, luminance, or a color emitted from a subpixel SP etc., it is possible for a waveform of luminance in the holding interval in various driving conditions in the low-speed drive mode to be identical or similar to a waveform of luminance in the refresh interval.

Accordingly, since an optimized reset voltage Vrst can be supplied in various driving conditions in the low-speed drive mode, it is possible to overcome further a flicker phenomenon in the low-speed drive mode.

Although preferred embodiments of the present disclosure have been described for illustrative purposes, those skilled in the art will appreciate that various modifications, additions and substitutions are possible, without departing from the scope and spirit of the invention as disclosed in the accompanying claims. Although the exemplary embodiments have been described for illustrative purposes, a person skilled in the art will appreciate that various modifications and applications are possible without departing from the essential characteristics of the present disclosure. For example, the specific components of the exemplary embodiments can be variously modified. The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device comprising:

a display panel including a plurality of gate lines, a plurality of data lines, and a plurality of subpixels;

a gate driving circuit configured to drive the plurality of gate lines; and a data driving circuit configured to drive the plurality of data lines, wherein each of the plurality of subpixels comprises:

a light-emitting element;

a driving transistor driving the light-emitting element, and including a first node electrically connected to a driving voltage line, a second node that is a gate node, and a third node electrically connected to the light-emitting element; and a scan transistor electrically connected between the third node and at least one of the plurality of data lines, wherein a data voltage is applied to the at least data line in a first interval, and a reset voltage is applied at least once to the at least data line in a second interval, of a frame period in a low-speed drive mode, and wherein a lowest level of a waveform of luminance of the display panel which is measured in the first interval is identical to a lowest level of a waveform of luminance of the display panel which is measured in the second interval.

2. The display device according to claim 1, wherein a level of the reset voltage is set according to a driving frequency in the low-speed drive mode.

3. The display device according to claim 1, wherein a level of the reset voltage is set according to luminance of the display panel in the low-speed drive mode.

4. The display device according to claim 1, wherein a level of the reset voltage is set according to a color emitted from at least one subpixel of the plurality of subpixels to which the data voltage is applied in the low-speed drive mode.

5. The display device according to claim 1, wherein the reset voltage is periodically applied in the second interval.

6. The display device according to claim 1, wherein the scan transistor is turned on in at least one sub-interval of an interval in which the reset voltage is applied in the second interval.

7. The display device according to claim 1, further comprising a first light-emitting transistor electrically connected between the third node and the light-emitting element, wherein the first light-emitting transistor is turned off in an interval in which the data voltage is applied, in the first interval, and turned on in an interval in which the reset voltage is applied in the second interval.

8. The display device according to claim 1, further comprising a second light-emitting transistor electrically connected between the first node and the driving voltage line, wherein the second light-emitting transistor is turned off in an interval in which the reset voltage is applied in the second interval.

9. The display device according to claim 1, further comprising a compensation transistor electrically connected between the first node and the second node, wherein the compensation transistor is turned on in at least one sub-interval of an interval in which the data voltage is applied in the first interval, and turned off in an interval in which the reset voltage is applied in the second interval.

10. A display panel comprising:

a plurality of gate lines;

a plurality of data lines; and a plurality of subpixels disposed in an area defined by intersecting of the plurality f gate lines and the plurality of data lines, wherein each of the plurality of subpixels comprises:

a light-emitting element;

a driving transistor driving the light-emitting element, and including a first node electrically connected to a driving voltage line, a second node that is a gate node, and a third node electrically connected to the light-emitting element; and a scan transistor electrically connected between the third node and at least one of the plurality of data lines, wherein a data voltage is applied to the at least one data line in a first interval, and a reset voltage is applied at least once to the at least one data line in a second interval, of a frame period in a low-speed drive mode, and wherein a lowest level of a waveform of luminance which is measured in the first interval is identical to a lowest level of a waveform of luminance which is measured in the second interval.

11. The display panel according to claim 10, wherein a level of the reset voltage is set based on at least one of a driving frequency in the low-speed drive mode, luminance representing in the low-speed drive mode, or a color emitted from at least one of the plurality of subpixels to which the data voltage is applied.

12. The display panel according to claim 10, wherein the scan transistor is turned on in at least one sub-interval of an interval in which the reset voltage is applied in the second interval.

13. The display panel according to claim 10, further comprising a first light-emitting transistor electrically connected between the third node and the light-emitting element, wherein the first light-emitting transistor is turned off in an interval in which the data voltage is applied in the first interval, and turned on in an interval in which the reset voltage is applied in the second interval.

14. The display panel according to claim 10, further comprising a second light-emitting transistor electrically connected between the first node and the driving voltage line, wherein the second light-emitting transistor is turned off in an interval in which the reset voltage is applied in the second interval.

15. The display panel according to claim 10, further comprising a compensation transistor electrically connected between the first node and the second node, wherein the compensation transistor is turned on in at least one sub-interval of an interval in which the data voltage is applied in the first interval, and turned off in an interval in which the reset voltage is applied in the second interval.

16. A data driving circuit comprising:

a data voltage output unit configured to output a data voltage to a data line in a first interval of a frame period; and a reset voltage output unit configured to periodically output at least once a reset voltage to the data line in a second interval after the first interval of the frame period in a low-speed drive mode, wherein a level of the reset voltage is set based on at least one of a driving frequency in the low-speed drive mode, luminance caused by the data voltage, or a color emitted from a subpixel to which the data voltage is applied, and wherein the first interval and the second interval are included in the frame period, and in the first interval, the data voltage is supplied to the subpixel through the data line, and in the second interval, a light-emitting element disposed in the subpixel supplied with the data voltage emits a light.

17. The data driving circuit according to claim 16, wherein reset voltage output unit outputs the reset voltage once for each interval having a length identical to a length of the first interval during the second interval in the low-speed drive mode.

18. The data driving circuit according to claim 16, wherein the reset voltage output unit outputs at least two reset voltages with different levels according to at least one of the driving frequency in the low-speed drive mode, the luminance caused by the data voltage, or the color emitted from the subpixel to which the data voltage is applied.

* * * * *